US008766519B2

(12) United States Patent
Ma

(10) Patent No.: US 8,766,519 B2
(45) Date of Patent: Jul. 1, 2014

(54) ELECTRODE MATERIAL FOR A SPARK PLUG

(75) Inventor: Shuwei Ma, Ann Arbor, MI (US)

(73) Assignee: Federal-Mogul Ignition Company, Southfield, MI (US)

( * ) Notice: Subject to any disclaimer, the term of this patent is extended or adjusted under 35 U.S.C. 154(b) by 0 days.

(21) Appl. No.: 13/533,264

(22) Filed: Jun. 26, 2012

(65) Prior Publication Data

US 2013/0002121 A1 Jan. 3, 2013

Related U.S. Application Data

(60) Provisional application No. 61/502,114, filed on Jun. 28, 2011.

(51) Int. Cl.
*H01T 13/20* (2006.01)

(52) U.S. Cl.
USPC ..... 313/141; 313/140

(58) Field of Classification Search
USPC ..... 313/140, 141, 118; 445/7
See application file for complete search history.

(56) References Cited

U.S. PATENT DOCUMENTS

| | | | |
|---|---|---|---|
| 2,328,580 | A | 9/1943 | Pickus |
| 2,391,456 | A | 12/1945 | Hensel |
| 2,391,457 | A | 12/1945 | Carlson |
| 2,406,172 | A | 8/1946 | Smithells |
| 2,470,034 | A | 5/1949 | Hensel |
| 2,545,438 | A | 3/1951 | Stumbpck |
| 3,159,460 | A | 12/1964 | Hill |
| 3,278,280 | A | 10/1966 | Holtz |
| 3,362,799 | A | 1/1968 | Jones |
| 3,466,158 | A | 9/1969 | Rhys |
| 3,528,862 | A | 9/1970 | Jones et al. |
| 3,868,430 | A | 2/1975 | Giangaspero et al. |
| 3,957,451 | A | 5/1976 | Rasmussen et al. |
| 3,977,841 | A | 8/1976 | Rasmussen et al. |
| 4,324,588 | A | 4/1982 | Zysk et al. |
| 4,351,095 | A | 9/1982 | Davies |
| 4,427,915 | A | 1/1984 | Nishio et al. |

(Continued)

FOREIGN PATENT DOCUMENTS

| | | |
|---|---|---|
| DE | 10005559 | 8/2001 |
| GB | 556253 | 9/1943 |

(Continued)

OTHER PUBLICATIONS

International Search Report for PCT/US2010/058501, Aug. 31, 2011, 3 pages.

(Continued)

*Primary Examiner* — Joseph L Williams
(74) *Attorney, Agent, or Firm* — Reising Ethington P.C.

(57) ABSTRACT

An electrode material for use with spark plugs and other ignition devices, where the electrode material includes ruthenium (Ru), plus one or more additional constituents like precious metals, refractory metals, active elements, metal oxides, or a combination thereof. In one example, the electrode material is a multi-phase material that has a matrix phase including ruthenium (Ru) and one or more precious metals, refractory metals and/or active elements, and a dispersed phase including a metal oxide. The metal oxide may be provided in particle form or fiber/whisker form, and is dispersed throughout the matrix phase. A powder metallurgy process for forming the electrode material into a spark plug electrode is also provided.

13 Claims, 4 Drawing Sheets

(56) References Cited

U.S. PATENT DOCUMENTS

| | | | |
|---|---|---|---|
| 4,659,960 | A | 4/1987 | Toya |
| 4,692,657 | A | 9/1987 | Grunwald et al. |
| 4,743,793 | A | 5/1988 | Toya et al. |
| 4,771,209 | A | 9/1988 | Ryan |
| 4,786,267 | A | 11/1988 | Toya et al. |
| 4,881,913 | A | 11/1989 | Mann |
| 4,910,428 | A | 3/1990 | Strumbos |
| 4,939,409 | A | 7/1990 | Friese et al. |
| 5,101,135 | A | 3/1992 | Oshima |
| 5,347,193 | A | 9/1994 | Oshima et al. |
| 5,448,130 | A | 9/1995 | Matsutani et al. |
| 5,456,624 | A | 10/1995 | Moore |
| 5,461,275 | A | 10/1995 | Oshima |
| 5,514,929 | A | 5/1996 | Kawamura |
| 5,550,425 | A | 8/1996 | Yoder |
| 5,578,895 | A | 11/1996 | Oshima |
| 5,675,209 | A | 10/1997 | Hall, Jr. |
| 5,793,793 | A | 8/1998 | Matsutani et al. |
| 5,796,019 | A | 8/1998 | Lupton |
| 5,866,973 | A | 2/1999 | Kagawa et al. |
| 5,869,921 | A | 2/1999 | Matsutani et al. |
| 5,890,272 | A | 4/1999 | Liberman |
| 5,894,186 | A | 4/1999 | Matsutani et al. |
| 5,898,257 | A | 4/1999 | Sequerra et al. |
| 5,990,602 | A | 11/1999 | Katoh et al. |
| 5,997,695 | A | 12/1999 | Ilmarinen |
| 5,998,913 | A | 12/1999 | Matsutani et al. |
| 6,045,424 | A | 4/2000 | Chang et al. |
| 6,046,532 | A | 4/2000 | Matsutani et al. |
| 6,071,163 | A | 6/2000 | Chang et al. |
| 6,094,000 | A | 7/2000 | Osamura et al. |
| 6,095,124 | A | 8/2000 | Matsubara et al. |
| 6,121,719 | A | 9/2000 | Matsutani et al. |
| 6,166,479 | A | 12/2000 | Matsutani et al. |
| 6,262,522 | B1 | 7/2001 | Osamura et al. |
| 6,304,022 | B1 | 10/2001 | Matsutani et al. |
| 6,326,719 | B1 | 12/2001 | Boehler |
| 6,407,487 | B1 | 6/2002 | Sugimoto |
| 6,412,465 | B1 | 7/2002 | Lykowski |
| 6,523,515 | B2 | 2/2003 | Kanao |
| 6,533,628 | B1 | 3/2003 | Matsutani |
| 6,579,738 | B2 | 6/2003 | Farrar |
| 6,611,083 | B2 | 8/2003 | LaBarge et al. |
| 6,628,051 | B1 | 9/2003 | Menken |
| 6,664,719 | B2 | 12/2003 | Matsutani et al. |
| 6,750,597 | B1 | 6/2004 | Sakura |
| 6,790,113 | B1 | 9/2004 | Fujita |
| 6,794,803 | B2 | 9/2004 | Hori et al. |
| 6,798,125 | B2 | 9/2004 | Sugiyama et al. |
| 6,864,622 | B2 | 3/2005 | Matsutani et al. |
| 6,869,328 | B2 | 3/2005 | Ulm et al. |
| 7,084,558 | B2 | 8/2006 | Teramura et al. |
| 7,131,191 | B2 | 11/2006 | Matsutani et al. |
| 7,132,782 | B2 | 11/2006 | Kato et al. |
| 7,150,252 | B2 | 12/2006 | Sugiyama et al. |
| 7,164,225 | B2 | 1/2007 | Yoshimoto et al. |
| 7,221,078 | B2 | 5/2007 | Watanabe |
| 7,279,827 | B2 | 10/2007 | Nunome et al. |
| 7,288,879 | B2 | 10/2007 | Matsutani et al. |
| 7,321,187 | B2 | 1/2008 | Teramura et al. |
| 7,336,024 | B2 | 2/2008 | Yoshimoto et al. |
| 7,382,084 | B2 | 6/2008 | Yoshimoto et al. |
| 7,385,339 | B2 | 6/2008 | Lineton et al. |
| 7,449,823 | B2 | 11/2008 | Menken et al. |
| 7,569,979 | B2 | 8/2009 | Lykowski et al. |
| 7,637,793 | B2 | 12/2009 | Lintunen et al. |
| 7,815,849 | B2 | 10/2010 | Koch et al. |
| 2002/0024160 | A1 | 2/2002 | Sugimoto |
| 2003/0178925 | A1 | 9/2003 | Kumagai |
| 2004/0140745 | A1 | 7/2004 | Hrastnik |
| 2005/0168121 | A1 | 8/2005 | Tinwell |
| 2005/0179353 | A1 | 8/2005 | Watanabe |
| 2006/0158082 | A1 | 7/2006 | Menken |
| 2007/0057613 | A1 | 3/2007 | Brady |
| 2007/0190364 | A1 | 8/2007 | Das |
| 2007/0236123 | A1 | 10/2007 | Lykowski |
| 2007/0236124 | A1 | 10/2007 | Lykowski |
| 2008/0074025 | A1 | 3/2008 | Hori |
| 2008/0206601 | A1 | 8/2008 | Mukai |
| 2008/0308057 | A1 | 12/2008 | Lykowski |
| 2009/0284117 | A1 | 11/2009 | Lykowski |
| 2010/0026159 | A1 | 2/2010 | Ohm |
| 2010/0052497 | A1 | 3/2010 | Walker, Jr. |
| 2010/0109502 | A1 | 5/2010 | Nakayama |
| 2010/0117506 | A1 | 5/2010 | Suzuki |
| 2010/0253203 | A1 | 10/2010 | Suzuki |
| 2010/0264801 | A1 | 10/2010 | Tanaka |
| 2010/0264802 | A1 | 10/2010 | Tanaka |
| 2011/0043093 | A1 | 2/2011 | Nunome |
| 2011/0121713 | A1* | 5/2011 | Ma ..... 313/141 |
| 2011/0127900 | A1 | 6/2011 | Ma |
| 2011/0198983 | A1 | 8/2011 | Manhardt |
| 2012/0025690 | A1 | 2/2012 | Kohl |
| 2012/0025692 | A1 | 2/2012 | Ma |

FOREIGN PATENT DOCUMENTS

| | | |
|---|---|---|
| GB | 575998 | 3/1946 |
| GB | 717496 | 10/1954 |
| GB | 755835 | 8/1956 |
| GB | 830628 | 3/1960 |
| JP | 2207476 | 8/1990 |
| JP | 7268574 | 10/1995 |
| JP | 8339880 | 12/1996 |
| JP | 2000331770 | 11/2000 |
| JP | 2001262253 | 9/2001 |
| JP | 2002346625 | 12/2002 |
| JP | 2003053419 | 2/2003 |
| JP | 2004031300 | 1/2004 |
| JP | 3902756 | 5/2004 |
| JP | 2004235040 | 8/2004 |
| JP | 2008053017 | 3/2008 |
| JP | 2008053018 | 3/2008 |
| KR | 20020050486 | 6/2002 |

OTHER PUBLICATIONS

Written Opinion & International Search Report for PCT/US11/45767, Mar. 20, 2012, 11 pages.

Written Opinion & International Search Report for PCT/US12/044160, Jan. 25, 2013, 9 pages.

* cited by examiner

ELECTRODE MATERIAL FOR A SPARK PLUG

REFERENCE TO RELATED APPLICATIONS

This application claims the benefit of U.S. Provisional Ser. No. 61/502,114 filed on Jun. 28, 2011, the entire contents of which are incorporated herein.

TECHNICAL FIELD

This invention generally relates to spark plugs and other ignition devices for internal combustion engines and, in particular, to electrode materials for spark plugs.

BACKGROUND

Spark plugs can be used to initiate combustion in internal combustion engines. Spark plugs typically ignite a gas, such as an air/fuel mixture, in an engine cylinder or combustion chamber by producing a spark across a spark gap defined between two or more electrodes. Ignition of the gas by the spark causes a combustion reaction in the engine cylinder that is responsible for the power stroke of the engine. The high temperatures, high electrical voltages, rapid repetition of combustion reactions, and the presence of corrosive materials in the combustion gases can create a harsh environment in which the spark plug must function. This harsh environment can contribute to erosion and corrosion of the electrodes that can negatively affect the performance of the spark plug over time, potentially leading to a misfire or some other undesirable condition.

To reduce erosion and corrosion of the spark plug electrodes, various types of precious metals and their alloys—such as those made from platinum and iridium—have been used. These materials, however, can be costly. Thus, spark plug manufacturers sometimes attempt to minimize the amount of precious metals used with an electrode by using such materials only at a firing tip or spark portion of the electrodes where a spark jumps across a spark gap.

SUMMARY

According to one aspect, there is provided a spark plug, comprising: a metallic shell, an insulator, a center electrode, and a ground electrode. The center electrode, the ground electrode, or both has an electrode material that includes ruthenium (Ru), at least one precious metal other than ruthenium (Ru), and at least one metal oxide, where ruthenium (Ru) is the single largest constituent of the electrode material on a wt % basis.

According to another aspect, there is provided a spark plug electrode, comprising: an electrode material that includes a matrix phase having ruthenium (Ru) and a dispersed phase having at least one metal oxide, where the ruthenium (Ru) is the single largest constituent of the electrode material on a wt % basis.

According to another aspect, there is provided a method of forming a spark plug electrode. The method may comprise the steps of: (a) providing ruthenium (Ru) and at least one precious metal in powder form, and providing a metal oxide in either particle form or fiber form; (b) adding the ruthenium (Ru), the at least one precious metal, and the metal oxide together so that a powder mixture is formed; (c) sintering the powder mixture to form an electrode material, wherein ruthenium (Ru) is the single largest constituent of the electrode material on a wt % basis; and (d) forming the electrode material into a spark plug electrode.

BRIEF DESCRIPTION OF THE DRAWINGS

Preferred exemplary embodiments of the invention will hereinafter be described in conjunction with the appended drawings, wherein like designations denote like elements, and wherein.

DETAILED DESCRIPTION OF THE PREFERRED EMBODIMENTS

Figure 1:
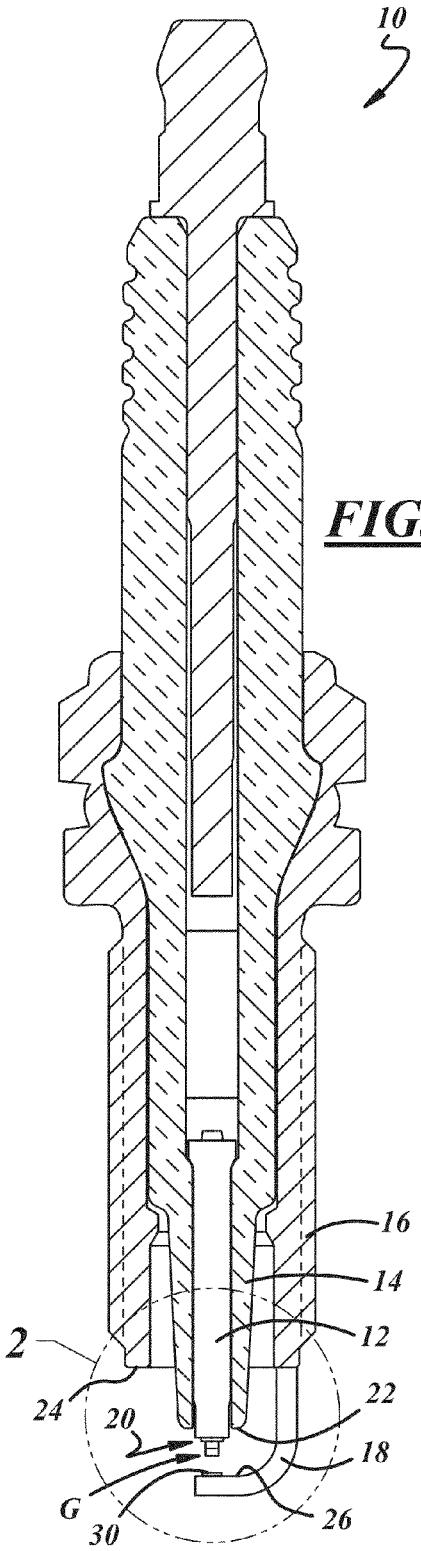
FIG. 1 is a cross-sectional view of an exemplary spark plug that may use the electrode material described below.

The electrode material described herein may be used in spark plugs and other ignition devices including industrial plugs, aviation igniters, glow plugs, or any other device that is used to ignite an air/fuel mixture in an engine. This includes, but is certainly not limited to, the exemplary spark plugs that are shown in the drawings and are described below. Furthermore, it should be appreciated that the electrode material may be used in a firing tip that is attached to a center and/or ground electrode or it may be used in the actual center and/or ground electrode itself, to cite several possibilities. Other embodiments and applications of the electrode material are also possible. All percentages provided herein are in terms of weight percentage (wt %), unless stated otherwise.

Figure 2:
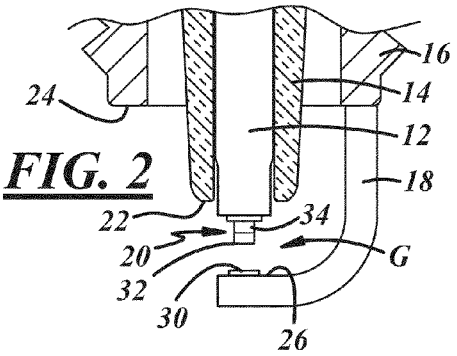
FIG. 2 is an enlarged view of the firing end of the exemplary spark plug from FIG. 1, wherein a center electrode has a firing tip in the form of a multi-piece rivet and a ground electrode has a firing tip in the form of a flat pad.

Referring to FIGS. 1 and 2, there is shown an exemplary spark plug 10 that includes a center electrode 12, an insulator 14, a metallic shell 16, and a ground electrode 18. The center electrode or base electrode member 12 is disposed within an axial bore of the insulator 14 and includes a firing tip 20 that protrudes beyond a free end 22 of the insulator 14. The firing tip 20 is a multi-piece rivet that includes a first component 32 made from an erosion- and/or corrosion-resistant material, like the electrode material described below, and a second component 34 made from an intermediary material like a high-chromium nickel alloy. In this particular embodiment, the first component 32 has a cylindrical shape and the second component 34 has a stepped shape that includes a diametrically-enlarged head section and a diametrically-reduced stem section. The first and second components may be attached to one another via a laser weld, a resistance weld, or some other suitable welded or non-welded joint. Insulator 14 is disposed within an axial bore of the metallic shell 16 and is constructed from a material, such as a ceramic material, that is sufficient to electrically insulate the center electrode 12 from the metallic shell 16. The free end 22 of the insulator 14 may protrude beyond a free end 24 of the metallic shell 16, as shown, or it may be retracted within the metallic shell 16. The ground electrode or base electrode member 18 may be constructed according to the conventional L-shape configuration shown in the drawings or according to some other arrangement, and is attached to the free end 24 of the metallic shell 16. According to this particular embodiment, the ground electrode 18 includes a side surface 26 that opposes the firing tip 20 of the center electrode and has a firing tip 30 attached thereto. The firing tip 30 is in the form of a flat pad and defines a spark gap G with the center electrode firing tip 20 such that they provide sparking surfaces for the emission and reception of electrons across the spark gap.

Figure 3:
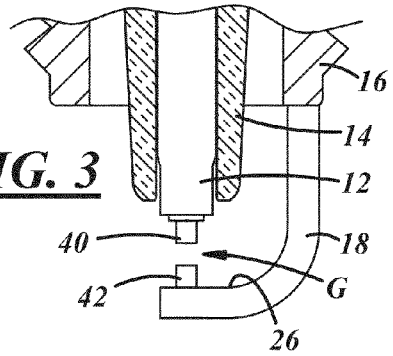
FIG. 3 is an enlarged view of a firing end of another exemplary spark plug that may use the electrode material described below, wherein the center electrode has a firing tip in the form of a single-piece rivet and the ground electrode has a firing tip in the form of a cylindrical tip.
Figure 4:
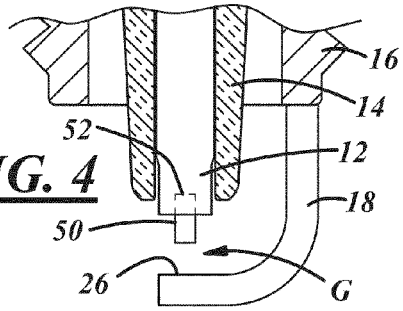
FIG. 4 is an enlarged view of a firing end of another exemplary spark plug that may use the electrode material described below, wherein the center electrode has a firing tip in the form of a cylindrical tip located in a recess and the ground electrode has no firing tip.
Figure 5:
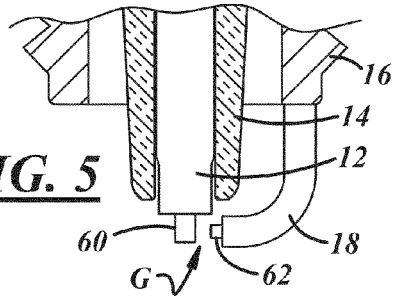
FIG. 5 is an enlarged view of a firing end of another exemplary spark plug that may use the electrode material described below, wherein the center electrode has a firing tip in the form of a cylindrical tip and the ground electrode has a firing tip in the form of a cylindrical tip that extends from an axial end of the ground electrode.

In this particular embodiment, the first component 32 of the center electrode firing tip 20 and/or the ground electrode firing tip 30 may be made from the electrode material described herein; however, these are not the only applications for the electrode material. For instance, as shown in FIG. 3, the exemplary center electrode firing tip 40 and/or the ground electrode firing tip 42 may also be made from the electrode material. In this case, the center electrode firing tip 40 is a single-piece rivet and the ground electrode firing tip 42 is a cylindrical tip that extends away from a side surface 26 of the ground electrode by a considerable distance. The electrode material may also be used to form the exemplary center electrode firing tip 50 and/or the ground electrode 18 that is shown in FIG. 4. In this example, the center electrode firing tip 50 is a cylindrical component that is located in a recess or blind hole 52, which is formed in the axial end of the center electrode 12. The spark gap G is formed between a sparking surface of the center electrode firing tip 50 and a side surface 26 of the ground electrode 18, which also acts as a sparking surface. FIG. 5 shows yet another possible application for the electrode material, where a cylindrical firing tip 60 is attached to an axial end of the center electrode 12 and a cylindrical firing tip 62 is attached to an axial end of the ground electrode 18. The ground electrode firing tip 62 forms a spark gap G with a side surface of the center electrode firing tip 60, and is thus a somewhat different firing end configuration than the other exemplary spark plugs shown in the drawings.

Again, it should be appreciated that the non-limiting spark plug embodiments described above are only examples of some of the potential uses for the electrode material, as it may be used or employed in any firing tip, electrode, spark surface, or other firing end component that is used in the ignition of an air/fuel mixture in an engine. For instance, the following components may be formed from the electrode material: center and/or ground electrodes; center and/or ground electrode firing tips that are in the shape of rivets, cylinders, bars, columns, wires, balls, mounds, cones, flat pads, disks, rings, sleeves, etc.; center and/or ground electrode firing tips that are attached directly to an electrode or indirectly to an electrode via one or more intermediate, intervening or stress-releasing layers; center and/or ground electrode firing tips that are located within a recess of an electrode, embedded into a surface of an electrode, or are located on an outside of an electrode such as a sleeve or other annular component; or spark plugs having multiple ground electrodes, multiple spark gaps or semi-creeping type spark gaps. These are but a few examples of the possible applications of the electrode material, others exist as well. As used herein, the term "electrode"—whether pertaining to a center electrode, a ground electrode, a spark plug electrode, etc.—may include a base electrode member by itself, a firing tip by itself, or a combination of a base electrode member and one or more firing tips attached thereto, to cite several possibilities.

Figure 6:
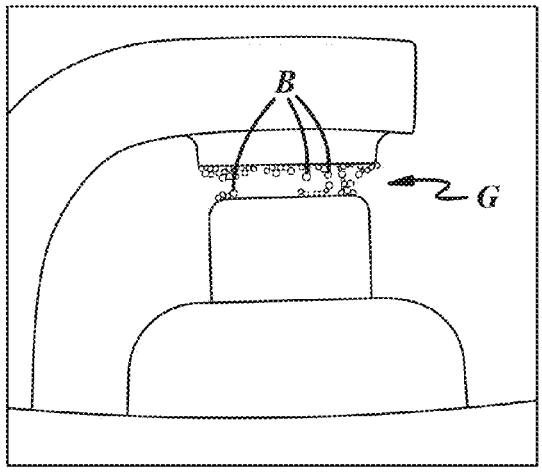
FIG. 6 is a schematic representation of a so-called balling and bridging phenomenon at the electrodes of an exemplary spark plug that does not use the electrode material described below.
Figure 7:
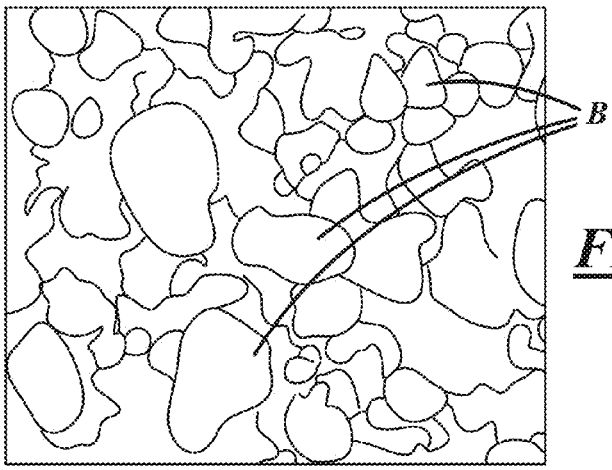
FIG. 7 is an enlarged schematic representation of the balling and bridging phenomenon of FIG. 6.
Figure 8:
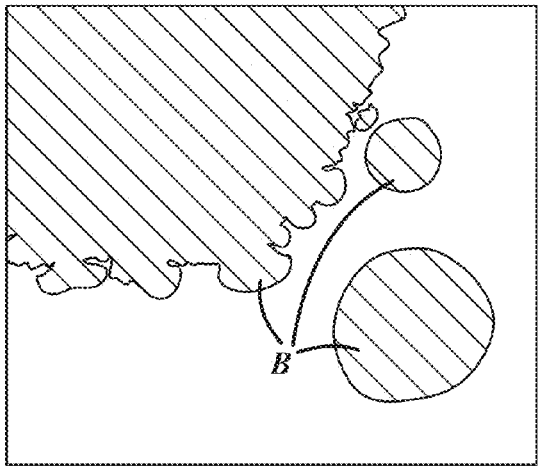
FIG. 8 is a cross-sectional schematic representation of the balling and bridging phenomenon of FIG. 6.

The electrode material described herein is composed of a ruthenium (Ru) based alloy and a metal oxide. Ruthenium-based alloys exhibit a degree of oxidation, corrosion, and erosion resistance that is desirable in certain applications including in internal combustion engines. But not all Ru-based alloys are as effective as desired. Referring to FIGS. 6-8, for example, it has been discovered that some Ru-based alloys experience a so-called balling and bridging phenomenon in which local oxidation and re-deposition of material creates Ru balls B at a surface thereof. This can occur during high temperature operations in an internal combustion engine, and, over time, the Ru balls B can collect and form a bridge across the spark gap G. When formed, the Ru balls B contribute to erosion (e.g., mass loss and wear) and corrosion of the spark plug electrodes and negatively affect the spark performance of the spark plug. It has been found that the electrode materials described below limit or altogether prevent this balling and bridging phenomenon. Without wishing to be limited to a particular theory of operation, it is currently believed that, among other factors, a relatively increased surface tension or increased surface energy exhibited by the electrode materials described below contributes to limiting or preventing the balling and bridging phenomenon and to limiting or preventing erosion.

The term "ruthenium-based material" or "ruthenium-based alloy," as used herein, broadly includes any material where ruthenium is the single largest constituent on a weight % basis. This may include materials having greater than 50% ruthenium, as well as those having less than 50% ruthenium so long as the ruthenium is the single largest constituent. Skilled artisans will appreciate that ruthenium has a rather high melting temperature (2334° C.) compared to some precious metals, which can improve the erosion resistance of the electrode material. But ruthenium can be more susceptible to oxidation than some precious metals, which can lower the corrosion resistance of the electrode material. Therefore, the electrode material may include ruthenium plus one or more additional constituents like precious metals, refractory metals, active elements, metal oxides or a combination thereof, each of which is selected to impart certain properties or attributes to the electrode material.

The precious metal provides the electrode material with a variety of desirable attributes, including a high resistance to oxidation, corrosion, or both. The precious metal that is added to the present electrode material may include any of the platinum-group metals or any other suitable precious metal found in groups 8, 9, 10 or 11 of the attached periodic table.

The periodic table (hereafter the "attached periodic table") is published by the International Union of Pure and Applied Chemistry (IUPAC) and is to be used with the present application. Some non-limiting examples of precious metals that are suitable for use in the electrode material, other than ruthenium (Ru), include rhodium (Rh), platinum (Pt), palladium (Pd), and iridium (Ir).

In some instances, the precious metal(s) may improve the wear resistance of the electrode material by forming stable protective oxides, such as rhodium oxide ($RhO_2$). The stable protective surface layer may act to prevent or retard further oxidation of the electrode material and thus prevent mass loss at high temperatures. The protective surface layer is typically dense, stable, and has a high partial vapor pressure and thus a low evaporation rate. Such attributes may contribute to the corrosion and/or erosion resistance characteristics of the electrode material, but the protective surface layer is certainly not necessary. In one embodiment, the stable protective surface layer has a thickness of about 1 to 12 microns (μm), includes rhodium oxide ($RhO_2$), and is formed at a temperature of at least 500 C.

The refractory metal also provides the electrode material with any number of desirable attributes, including a high melting temperature and correspondingly high resistance to spark erosion, as well as improved ductility during manufacturing. The refractory metal that is added to the present electrode material may include any refractory metal or any other suitable transition metal found in groups 5, 6 and 7 of the attached periodic table. In some examples, the selected refractory metal has a melting temperature greater than about 1,700° C. Some non-limiting examples of refractory metals that are suitable for use in the electrode material include tungsten (W), rhenium (Re), tantalum (Ta), molybdenum (Mo), and niobium (Nb). The added refractory metal, precious metal, or a combination of both, may cooperate with the ruthenium in the electrode material such that the electrode material has a high wear resistance, including significant resistance to spark erosion, chemical corrosion, oxidation, or a combination thereof, for example. The relatively high melting points of the refractory metals and the ruthenium may provide the electrode material with a high resistance to spark erosion or wear, while the precious metals may provide the electrode material with a high resistance to chemical corrosion, oxidation, or both.

When rhenium is used as the refractory metal in the electrode material, the electrode material is more ductile than some comparable ruthenium-based materials and other precious metal-based materials, yet still maintains an acceptable level of erosion and corrosion resistance. The ductility of the electrode materials with rhenium makes them more workable so that they can be more easily turned into a useful part. For example, for the multi-layer rivet (MLR) design discussed above and shown in FIGS. 1 and 2, a firing tip component 32 made from these more ductile electrode materials can be easily sheared off from a wire during manufacturing, and this can be done in at least some cases without the use of a diamond saw or similar apparatus. In some embodiments, the ductility improvement in the electrode material is at least partially attributable to the addition of rhenium and the particular manufacturing techniques involved, such as the powder metallurgy sintering and the post-sintering extrusion process taught below; other factors can contribute to the ductility improvement.

A table listing some exemplary precious and refractory metals, as well as their corresponding melting temperatures, is provided below (TABLE I).

TABLE I

Melting Temperatures of Exemplary Metals

| | Melting Temperature (° C.) |
|---|---|
| Precious Metals | |
| Rhodium (Rh) | 1964 |
| Platinum (Pt) | 1768 |
| Palladium (Pd) | 1555 |
| Iridium (Ir) | 2446 |
| Refractory Metals | |
| Tungsten (W) | 3422 |
| Molybdenum (Mo) | 2623 |
| Niobium (Nb) | 2468 |
| Tantalum (Ta) | 2996 |
| Rhenium (Re) | 3186 |

Some active elements, including rare earth elements, may be added to the ruthenium-based electrode material. The doping of active elements into the electrode material may improve the ductility of the material at room temperature, which can cut the fabricating cost of these alloys. The added active elements can react or combine with impurities in the electrode material and can form dispersed fine particles in grains, thus, making cleaner grain boundaries. This kind of grain boundary interaction can improve the ductility of ruthenium-based alloys. Some suitable examples of active elements that may be added to the electrode material include aluminum (Al), titanium (Ti), zirconium (Zr), scandium (Sc), as well as rare elements like yttrium (Y) and halfnium (Hf), lanthanoids (such as La) and actinoids (such as Ac). The total amount of active elements in the ruthenium-based material may be in the range of 10 ppm to 0.5 wt %, and they may be added in with any suitable combination of other constituents such as precious metals, refractory elements, metal oxides, etc.

The addition of the metal oxide in the electrode material may provide any number of desirable attributes, including limiting or preventing the balling and bridging phenomenon described above with reference to FIGS. 6-8. In this way and in other ways, the metal oxide can limit erosion such as mass loss and wear of the electrode material when the electrode material is used in spark plug applications. The metal oxide can increase the overall melting temperature of the electrode material which may also enhance its ability to resist erosion. In some examples, the metal oxide is present in the electrode material from about 0.1 wt % to about 5.0 wt %, inclusive, or about 1.0 wt %. The particle size of the metal oxides at an initial stage of manufacturing, as described below, may range from about 1 nm to about 20 μm. Some non-limiting examples of metal oxides that are suitable for use in the electrode material include $Al_2O_3$, $ZrO_2$, MgO, $SnO_2$, CaO, $Cr_2O_3$, $CeO_2$, HfO, $Y_2O_3$, SiC and $La_2O_3$; among these, $Y_2O_3$, $ZrO_2$, CaO, and MgO can exhibit a suitable negative Gibbs free energy.

The metal oxide may be introduced into the electrode material in the form of dispersed particles or fibers such that a multi-phase material is created having both a matrix phase and a dispersed phase. This may have an effect on the surface tension of the material, which is generally a property of the surface of a liquid that allows it to resist an external force and is caused by the cohesion of molecules. Furthermore, by introducing low-cost metal oxide elements into the electrode material, whether they be in particle or fiber form, the overall cost of the material goes down as these elements typically cost less than precious metals and/or other material constituents.

According to an embodiment where the metal oxide is in the form of dispersed particles, the electrode material includes a ruthenium-based matrix (e.g., a matrix that includes ruthenium and one or more precious metals, refractory metals and/or active elements, as described above) and metal oxide particles dispersed within the matrix. The ruthenium-based matrix may have a microstructure in the form of a solid solution ruthenium-based alloy with grains that range from the nano-size level to the micro-size level (e.g., from 1 μm to about 10 μm), while the individual metal oxide particles can have a mean particle size of about 1 nm to about 20 μm. The relative volume of the metal oxide particles in the ruthenium-based matrix can be approximately 0.1 vol % to 2 vol % of the overall material.

According a different embodiment where the metal oxide is in the form of dispersed fibers or whiskers, the electrode material includes a ruthenium-based matrix (e.g., the same matrix as in the particle embodiment) and metal oxide fibers or whiskers dispersed within the matrix. The fibers or whiskers may start out in a thin and elongated form and have a mean or average length of between about 50 μm and 500 μm and a mean diameter that is less than about 10 μm. When the fibers or whiskers are added to the electrode material—but before the powder metallurgical manufacturing processes described below—they may be randomly oriented within the ruthenium-based matrix. But after one or more drawing, extruding or other types of metal-working steps, the metal oxide fibers typically become oriented or aligned in the longitudinal direction of the drawn rod or wire, and may become more elongated so that their mean length is between about 1 mm to 10 mm (e.g., 3 mm to about 6 mm). One of the potentially beneficial aspects of using metal oxide or ceramic fibers, such as those made from $Al_2O_3$, is their relatively high melting points which can exceed 2000° C. or more. Several metal oxide compositions that may be particularly useful in certain spark plug applications include $Al_2O_3$, $ZrO_2$ and SiC.

Some non-limiting examples of potential electrode materials are provided below. All compositions are expressed in terms of wt %, where ruthenium constitutes the balance of the material and the cited ranges include the boundaries; that is, the ranges are "inclusive." In each of the exemplary material compositions listed below, the ruthenium, the precious metals, the refractory metals and/or the active elements could be part of the matrix phase, while the metal oxides could be part of the dispersed phase that is diffused within the matrix phase (a multi-phase material). Alternatively, it is possible for all of the constituents to be part of a generally homogeneous or uniform material (a single phase material), although this is not the preferred embodiment.

Examples of ruthenium-based alloys that have ruthenium (Ru) from about 80 wt % to 99.9 wt %, a precious metal from about 0.1 wt % to 20 wt %, and a metal oxide from about 0.1 wt % to 5 wt %, include: Ru—Rh-metal oxide, Ru—Pt-metal oxide, Ru—Ir-metal oxide, and Ru—Pd-metal oxide. More specific examples of such compositions include: Ru-(0.1-20)Rh-(0.1-5)$Y_2O_3$; Ru-(0.1-20)Rh-(0.1-5)$ZrO_2$; Ru-(0.1-20)Rh-(0.1-5)CaO; Ru-(0.1-20)Rh-(0.1-5)MgO; Ru-(0.1-20)Pt-(0.1-5)$Y_2O_3$; Ru-(0.1-20)Pt-(0.1-5)$ZrO_2$; Ru-(0.1-20)Pt-(0.1-5)CaO; Ru-(0.1-20)Pt-(0.1-5)MgO; Ru-(0.1-20)Ir-(0.1-5)$Y_2O_3$; Ru-(0.1-20)Ir-(0.1-5)$ZrO_2$; Ru-(0.1-20)Ir-(0.1-5)CaO; Ru-(0.1-20)Ir-(0.1-5)MgO; Ru-(0.1-20)Pd-(0.1-5)$Y_2O_3$; Ru-(0.1-20)Pd-(0.1-5)$ZrO_2$; Ru-(0.1-20)Pd-(0.1-5)CaO and Ru-(0.1-20)Pd-(0.1-5) MgO.

Examples of ruthenium-based alloys that have ruthenium (Ru) from about 80 wt % to 99.9 wt %, first and second precious metals with a combined weight from about 0.1 wt % to 20 wt %, and a metal oxide from about 0.1 wt % to 5 wt %, include: Ru—Rh—Pt-metal oxide, Ru—Rh—Pd-metal oxide, Ru—Rh—Ir—metal oxide, Ru—Pt—Rh-metal oxide, Ru—Pt—Pd-metal oxide, Ru—Pt—Ir-metal oxide, Ru—Pd—Rh-metal oxide, Ru—Pd—Pt-metal oxide, Ru—Pd—Ir-metal oxide, Ru—Ir—Rh-metal oxide, Ru—Ir—Pt-metal oxide and Ru—Ir—Pd-metal oxide. More specific examples of such compositions include: Ru-(0.1-20)Rh-(0.1-20)Pt-(0.1-5)$Y_2O_3$; Ru-(0.1-20)Rh-(0.1-20)Pt-(0.1-5)$ZrO_2$; Ru-(0.1-20)Rh-(0.1-20)Pt-(0.1-5)CaO; Ru-(0.1-20)Rh-(0.1-20)Pt-(0.1-5)MgO; Ru-(0.1-20)Rh-(0.1-20)Pd-(0.1-5)$Y_2O_3$; Ru-(0.1-20)Rh-(0.1-20)Pd-(0.1-5)$ZrO_2$; Ru-(0.1-20)Rh-(0.1-20)Pd-(0.1-5)CaO; Ru-(0.1-20)Rh-(0.1-20)Pd-(0.1-5)MgO; Ru-(0.1-20)Rh-(0.1-20)Ir-(0.1-5)$Y_2O_3$; Ru-(0.1-20)Rh-(0.1-20)Ir-(0.1-5)$ZrO_2$; Ru-(0.1-20)Rh-(0.1-20)Ir-(0.1-5)CaO; Ru-(0.1-20)Rh-(0.1-20)Ir-(0.1-5)MgO; Ru-(0.1-20)Pt-(0.1-20)Pd-(0.1-5)$Y_2O_3$; Ru-(0.1-20)Pt-(0.1-20)Pd-(0.1-5)$ZrO_2$; Ru-(0.1-20)Pt-(0.1-20)Pd-(0.1-5)CaO; Ru-(0.1-20)Pt-(0.1-20)Pd-(0.1-5)MgO; Ru-(0.1-20)Pt-(0.1-20)Ir-(0.1-5)$Y_2O_3$; Ru-(0.1-20)Pt-(0.1-20)Ir-(0.1-5)$ZrO_2$; Ru-(0.1-20)Pt-(0.1-20)Ir-(0.1-5)CaO; Ru-(0.1-20)Pt-(0.1-20)Ir-(0.1-5)MgO; Ru-(0.1-20)Pd-(0.1-20)Ir-(0.1-5)$Y_2O_3$; Ru-(0.1-20)Pd-(0.1-20)Ir-(0.1-5)$ZrO_2$; Ru-(0.1-20)Pd-(0.1-20)Ir-(0.1-5)CaO and Ru-(0.1-20)Pd-(0.1-20)Ir-(0.1-5) MgO. In other embodiments, the electrode material has three or more precious metals.

Examples of ruthenium-based alloys that have ruthenium (Ru) from about 80 wt % to 99.9 wt %, a precious metal from about 0.1 wt % to 20 wt %, a refractory metal from about 0.1 wt % to 5 wt %, and a metal oxide from about 0.1 wt % to 5 wt %, include: Ru-precious metal(s)-W-metal oxide, Ru-precious metal(s)-Re-metal oxide, Ru-precious metal(s)-Ta-metal oxide, Ru-precious metal(s)-Mo-metal oxide and Ru-precious metal(s)-Nb-metal oxide. More specific examples of such compositions include: Ru-(0.1-20)Rh-(0.1-5)W-(0.1-5)$Y_2O_3$; Ru-(0.1-20)Rh-(0.1-5)W-(0.1-5)$ZrO_2$; Ru-(0.1-20)Rh-(0.1-5)W-(0.1-5)CaO; Ru-(0.1-20)Rh-(0.1-5)W-(0.1-5)MgO; Ru-(0.1-20)Rh-(0.1-5)Re-(0.1-5)$Y_2O_3$; Ru-(0.1-20)Rh-(0.1-5)Re-(0.1-5)$ZrO_2$; Ru-(0.1-20)Rh-(0.1-5)Re-(0.1-5)CaO; Ru-(0.1-20)Rh-(0.1-5)Re-(0.1-5)MgO; Ru-(0.1-20)Rh-(0.1-5)Ta-(0.1-5)$Y_2O_3$; Ru-(0.1-20)Rh-(0.1-5)Ta-(0.1-5)$ZrO_2$; Ru-(0.1-20)Rh-(0.1-5)Ta-(0.1-5)CaO; Ru-(0.1-20)Rh-(0.1-5)Ta-(0.1-5)MgO; Ru-(0.1-20)Rh-(0.1-5)Mo-(0.1-5)$Y_2O_3$; Ru-(0.1-20)Rh-(0.1-5)Mo-(0.1-5)$ZrO_2$; Ru-(0.1-20)Rh-(0.1-5)Mo-(0.1-5)CaO; Ru-(0.1-20)Rh-(0.1-5)Mo-(0.1-5)MgO; Ru-(0.1-20)Rh-(0.1-5)Nb-(0.1-5)$Y_2O_3$; Ru-(0.1-20)Rh-(0.1-5)Nb-(0.1-5)$ZrO_2$; Ru-(0.1-20)Rh-(0.1-5)Nb-(0.1-5)CaO; Ru-(0.1-20)Rh-(0.1-5)Nb-(0.1-5)MgO; Ru-(0.1-20)Pt-(0.1-5)W-(0.1-5)$Y_2O_3$; Ru-(0.1-20)Pt-(0.1-5)W-(0.1-5)$ZrO_2$; Ru-(0.1-20)Pt-(0.1-5)W-(0.1-5)CaO; Ru-(0.1-20)Pt-(0.1-5)W-(0.1-5)MgO; Ru-(0.1-20)Pt-(0.1-5)Re-(0.1-5)$Y_2O_3$; Ru-(0.1-20)Pt-(0.1-5)Re-(0.1-5)$ZrO_2$; Ru-(0.1-20)Pt-(0.1-5)Re-(0.1-5)CaO; Ru-(0.1-20)Pt-(0.1-5)Re-(0.1-5)MgO; Ru-(0.1-20)Pt-(0.1-5)Ta-(0.1-5)$Y_2O_3$; Ru-(0.1-20)Pt-(0.1-5)Ta-(0.1-5)$ZrO_2$; Ru-(0.1-20)Pt-(0.1-5)Ta-(0.1-5)CaO; Ru-(0.1-20)Pt-(0.1-5)Ta-(0.1-5)MgO; Ru-(0.1-20)Pt-(0.1-5)Mo-(0.1-5)$Y_2O_3$; Ru-(0.1-20)Pt-(0.1-5)Mo-(0.1-5)$ZrO_2$; Ru-(0.1-20)Pt-(0.1-5)Mo-(0.1-5)CaO; Ru-(0.1-20)Pt-(0.1-5)Mo-(0.1-5)MgO; Ru-(0.1-20)Pt-(0.1-5)Nb-(0.1-5)$Y_2O_3$; Ru-(0.1-20)Pt-(0.1-5)Nb-(0.1-5)$ZrO_2$; Ru-(0.1-20)Pt-(0.1-5)Nb-(0.1-5)CaO; Ru-(0.1-20)Pt-(0.1-5)Nb-(0.1-5)MgO; Ru-(0.1-20)Ir-(0.1-5)Re-(0.1-5)$Y_2O_3$; Ru-(0.1-20)Ir-(0.1-5)Re-(0.1-5)$ZrO_2$; Ru-(0.1-20)Ir-(0.1-5)Re-(0.1-5)CaO; Ru-(0.1-20)Ir-(0.1-5)Re-(0.1-5)MgO; Ru-(0.1-20)Ir-(0.1-5)Re-(0.1-5)$La_2O_3$; Ru-(0.1-20)Ir-(0.1-5)Re-(0.1-5)$Al_2O_3$; Ru-(0.1-20)Ir-(0.1-5)Re-(0.1-5)$SnO_2$; Ru-(0.1-20)Ir-(0.1-5)Re-(0.1-5)$Cr_2O_3$; Ru-(0.1-20)Ir-(0.1-5)Re-(0.1-5)$CeO_2$ and Ru-(0.1-20)Ir-(0.1-5)Re-(0.1-5)HfO.

Examples of ruthenium-based alloys that have ruthenium (Ru) from about 80 wt % to 99.9 wt %, first and second precious metals with a combined weight from about 0.1 wt % to 20 wt %, a refractory metal from about 0.1 wt % to 5 wt %, and a metal oxide from about 0.1 wt % to 5 wt %, include: Ru—Rh—Pt—Re-metal oxide, Ru—Rh—Pt—W-metal oxide, Ru—Rh—Pt—Ta-metal oxide, Ru—Rh—Pt—Mo-metal oxide, Ru—Rh—Pt—Nb-metal oxide, Ru—Rh—Ir—W-metal oxide, Ru—Rh—Ir—Re-metal oxide, Ru—Rh—Ir—Ta-metal oxide, Ru—Rh—Ir—Mo-metal oxide, Ru—Rh—Ir—Nb-metal oxide, Ru—Rh—Pd—W-metal oxide, Ru—Rh—Pd—Re-metal oxide, Ru—Rh—Pd—Ta-metal oxide, Ru—Rh—Pd—Mo-metal oxide and Ru—Rh—Pd—Nb-metal oxide. More specific examples of such compositions include: Ru-(0.1-20)Rh-(0.1-20)Pt-(0.1-5)Re-(0.1-5)$Y_2O_3$; Ru-(0.1-20)Rh-(0.1-20)Pt-(0.1-5)Re-(0.1-5)$ZrO_2$; Ru-(0.1-20)Rh-(0.1-20)Pt-(0.1-5)Re-(0.1-5)CaO; Ru-(0.1-20)Rh-(0.1-20)Pt-(0.1-5)Re-(0.1-5)MgO; Ru-(0.1-20)Rh-(0.1-20)Pt-(0.1-5)Re-(0.1-5)$La_2O_3$; Ru-(0.1-20)Rh-(0.1-20)Pt-(0.1-5)Re-(0.1-5)$Al_2O_3$; Ru-(0.1-20)Rh-(0.1-20)Pt-(0.1-5)Re-(0.1-5)$SnO_2$; Ru-(0.1-20)Rh-(0.1-20)Pt-(0.1-5)Re-(0.1-5)$Cr_2O_3$; Ru-(0.1-20)Rh-(0.1-20)Pt-(0.1-5)Re-(0.1-5)$CeO_2$ and Ru-(0.1-20)Rh-(0.1-20)Pt-(0.1-5)Re-(0.1-5)HfO; Ru-(0.1-20)Rh-(0.1-20)Pt-(0.1-5)W-(0.1-5)$Y_2O_3$; Ru-(0.1-20)Rh-(0.1-20)Pt-(0.1-5)W-(0.1-5)$ZrO_2$; Ru-(0.1-20)Rh-(0.1-20)Pt-(0.1-5)W-(0.1-5)CaO; Ru-(0.1-20)Rh-(0.1-20)Pt-(0.1-5)W-(0.1-5)MgO; Ru-(0.1-20)Rh-(0.1-20)Pt-(0.1-5)W-(0.1-5)$La_2O_3$; Ru-(0.1-20)Rh-(0.1-20)Pt-(0.1-5)W-(0.1-5)$Al_2O_3$; Ru-(0.1-20)Rh-(0.1-20)Pt-(0.1-5)W-(0.1-5)$SnO_2$; Ru-(0.1-20)Rh-(0.1-20)Pt-(0.1-5)W-(0.1-5)$Cr_2O_3$; Ru-(0.1-20)Rh-(0.1-20)Pt-(0.1-5)W-(0.1-5)$CeO_2$ and Ru-(0.1-20)Rh-(0.1-20)Pt-(0.1-5)W-(0.1-5)HfO.

Other ruthenium-based alloys are certainly possible, including ones that that have ruthenium (Ru) from about 80 wt % to 99.9 wt %, first, second and third precious metals with a combined weight from about 0.1 wt % to 20 wt %, a refractory metal from about 0.1 wt % to 5 wt %, and a metal oxide from about 0.1 wt % to 5 wt %. Some non-limiting examples of such materials include: Ru-(0.1-20)(Pt+Rh+Ir)-(0.1-5)Re+(0.1-1)$Y_2O_3$; Ru-(0.1-20)(Pt+Rh+Ir)-(0.1-5)Re-(0.1-5)$ZrO_2$; Ru-(0.1-20)(Pt+Rh+Ir)-(0.1-5)Re-(0.1-5)CaO; Ru-(0.1-20)(Pt+Rh+Ir)-(0.1-5)Re-(0.1-5)MgO; Ru-(0.1-20)(Pt+Rh+Ir)-(0.1-5)Re-(0.1-5)$La_2O_3$; Ru-(0.1-20)(Pt+Rh+Ir)-(0.1-5)Re-(0.1-5)$Al_2O_3$; Ru-(0.1-20)(Pt+Rh+Ir)-(0.1-5)Re-(0.1-5)$SnO_2$; Ru-(0.1-20)(Pt+Rh+Ir)-(0.1-5)Re-(0.1-5)$Cr_2O_3$; Ru-(0.1-20)(Pt+Rh+Ir)-(0.1-5)Re-(0.1-5)$CeO_2$; and Ru-(0.1-20)(Pt+Rh+Ir)-(0.1-5)Re-(0.1-5)HfO.

Depending on the particular embodiment and the particular properties that are desired, the amount of ruthenium (Ru) in the ruthenium-based material may be: greater than or equal to 80 wt %, 85 wt %, 90 wt % or 95 wt %; less than or equal to 99.9%, 95 wt %, 90 wt % or 85 wt %, or 80%; or between 80-99.9%, 85-99.9 wt %, 90-99.9 wt % or 95-99.9 wt %. Likewise, the amount of any single precious metal in the ruthenium-based material may be: greater than or equal to 0.1 wt %, 1 wt %, 2 wt %, 10 wt % or 20 wt %; less than or equal to 20 wt %, 15 wt %, 10 wt % or 5 wt %; or between 0.1-20 wt %, 0.1-15 wt %, 0.1-10 wt %, 0.1-5 wt %, or 0.1-2 wt %. The total amount of precious metals in the ruthenium-based material may be: greater than or equal to 0.1 wt %, 1 wt %, 5 wt %, 10 wt % or 20 wt %; less than or equal to 20 wt %, 15 wt %, 10 wt %, 5 wt %, or 1 wt %; or between 1-20 wt %, 1-15 wt %, 1-10 wt % or 1-5 wt %. The amount of a refractory metal—i.e., a refractory metal other than ruthenium (Ru)—in the ruthenium-based material may be: greater than or equal to 0.1 wt %, 1 wt %, 2 wt %; less than or equal to 5 wt %, 2 wt % or 1 wt %; or between 0.1-5 wt %, 0.1-2 wt % or 0.1-1 wt %.

It should be appreciated that the preceding electrode material examples represent only some of the possible compositions. Other ruthenium-based binary, ternary, quaternary and other alloys may also exist. Some examples of electrode material compositions that may be particularly useful for certain spark plug applications include: Ru—Rh-metal oxide, where the Rh is between 0.1-20% wt; Ru—Rh—Ir-metal oxide where the Rh is between 0.1-20% wt and the Ir is between 0.1-10% wt; Ru—Rh—Re-metal oxide, where the Rh is between 0.1-20% wt and the Re is between 0.1-5% wt; Ru—Pd—Re-metal oxide, where the Pd is between 0.1-20% wt and the Re is between 0.1-5% wt; and Ru—Rh—Ir—Re-metal oxide, where the Rh is between 0.1-20% wt, the Ir is between 0.1-10% wt, and the Re is between 0.1-5% wt. In some of the preceding exemplary systems, the rhenium (Re) is added to improve the overall ductility of the electrode material so that it can be more easily manufactured.

Figure 10:
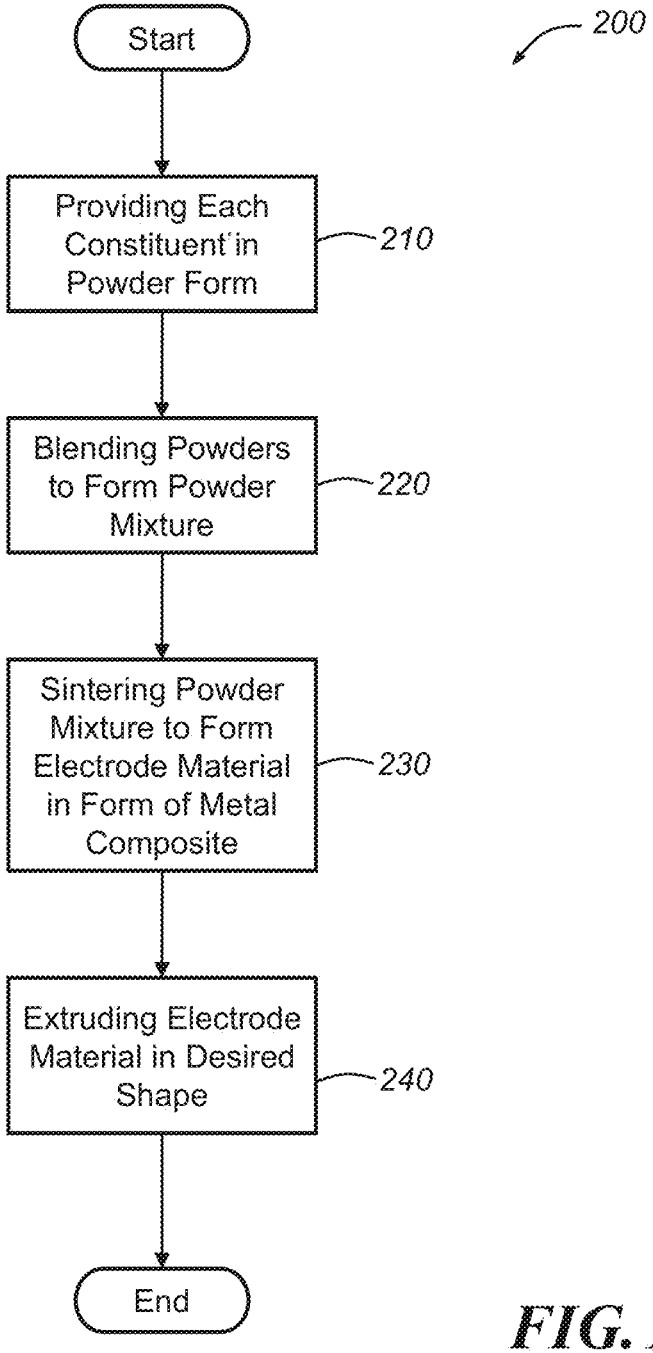
FIG. 10 is a flowchart illustrating an exemplary embodiment of a method for forming a spark plug electrode.

Turning now to FIG. 10, the electrode material described herein can be made using a variety of manufacturing processes, such as powder metallurgical methods. For instance, a process 200 may be used that includes the steps of: providing each of the constituents in powder form where they each have a certain powder, particle or fiber size, step 210; blending the constituents together to form a powder mixture, step 220; sintering the powder mixture to form the electrode material, step 230; and extruding, drawing, or otherwise forming the electrode material into a desired shape, step 240. The exemplary electrode material that is referenced in the following description is a multi-phase material that includes a matrix phase having ruthenium, one or more precious metals and one or more refractory metals, and a dispersed phase having metal oxide particles. It should be appreciated, however, that this method may be used to produce other suitable electrode materials as well (e.g., ones having a dispersed phase made from thin fibers or whiskers as opposed to particles).

In step 210, the ruthenium, one or more precious metals, one or more refractory metals, and the metal oxide are provided in powder form, each of which has a particular powder or particle size that may be dependent on a number of factors. According to an exemplary embodiment, the particle size of ruthenium (Ru), rhodium (Rh), platinum (Pt), and rhenium (Re) in powder form is about 0.1 μm to 200 μm, inclusive, and the particle size of the metal oxide when in a powder form is about 1 nm to about 20 μm, inclusive. Also, the weight percent of the metal oxide when in a powder form can be about 0.1 wt % to about 5.0 wt %, inclusive, of the overall powder mixture, and the volume fraction of the metal oxide when in powder form can be about 0.1 vol % to about 2 vol %, inclusive.

Next, step 220 blends the powders of the ruthenium, the precious metals, the refractory metals, and the metal oxide together so that a powder mixture is formed. This mixing step may be performed with or without the addition of heat. In one embodiment, metal oxide in powder form can be blended or mixed with a pre-alloyed base alloy powder. Some non-limiting examples of such a pre-alloyed base alloy powder include (all amounts on a wt % basis, unless otherwise stated) powders made from: Ru-(0.1-1)Re; Ru-2Rh-(0.1-1)Re; Ru-5Rh-(0.1-1)Re; Ru-10Rh-(0.1-1)Re; Ru-20Rh-(0.1-1)Re; and Ru-10Pt-10Rh-(0.1-1)Re, to provide some of the possibilities.

Sintering step 230 may be performed according to a number of different metallurgical embodiments. For instance, the resultant powder mixture may be sintered in a vacuum or in some type of protected environment at a sintering temperature of about 0.5-0.8$T_{melt}$ of the base alloy such as ruthenium or the pre-alloyed base alloy. Put differently, the sintering temperature may be set to approximately 50-80% of the melting temperature of the base alloy, which in the example cases is about 1,350° C.-1,600° C. It is also possible for sintering step 230 to apply pressure in order to introduce some type of porosity control to the electrode material. As will be appreciated by those skilled in the art, the amount of pressure applied may depend on the precise composition of the resultant powder mixture and the desired attributes of the electrode material.

Next, the electrode material may be extruded, drawn or otherwise formed into a desired shape, step 240. If an elongated wire is desired, then the electrode material may be cold extruded to form a fine wire of about 0.3 mm to about 1.5 mm, inclusive, which in turn can be cut or cross-sectioned into individual electrode tips or the like. Of course, other metal forming techniques could be used with step 240 to form the electrode material in parts having different shapes. For example, the electrode material could be swaged, forged, cast or otherwise formed into ingots, bars, rivets, tips, etc.

The above-described processes may be used to form the electrode material into various shapes (such as rods, wires, sheets, etc.) that are suitable for further spark plug electrode and/or firing tip manufacturing processes. Other known techniques such as melting and blending the desired amounts of each constituent may be used in addition to or in lieu of those steps mentioned above. The electrode material can be further processed using conventional cutting and grinding techniques that are sometimes difficult to use with other known erosion-resistant electrode materials.

In one particular example manufacturing process, a ruthenium-based electrode material of the composition Ru-5Rh-1Re-1$Y_2O_3$ begins by blending powders of 93 wt % Ru, 5 wt % Rh, 1 wt % Re, and 1 wt % $Y_2O_3$. The subsequent sintering step can be expedited by using particles of smaller size, for example on the micro size level. In this example too, a metal oxide powder has a particle size from about 1 nm to about 1 μm, inclusive. The resultant powder mixture can then sintered at about 1,450° C. for about 4-10 hours and under pressure of about 20 MPa.

Figure 9:
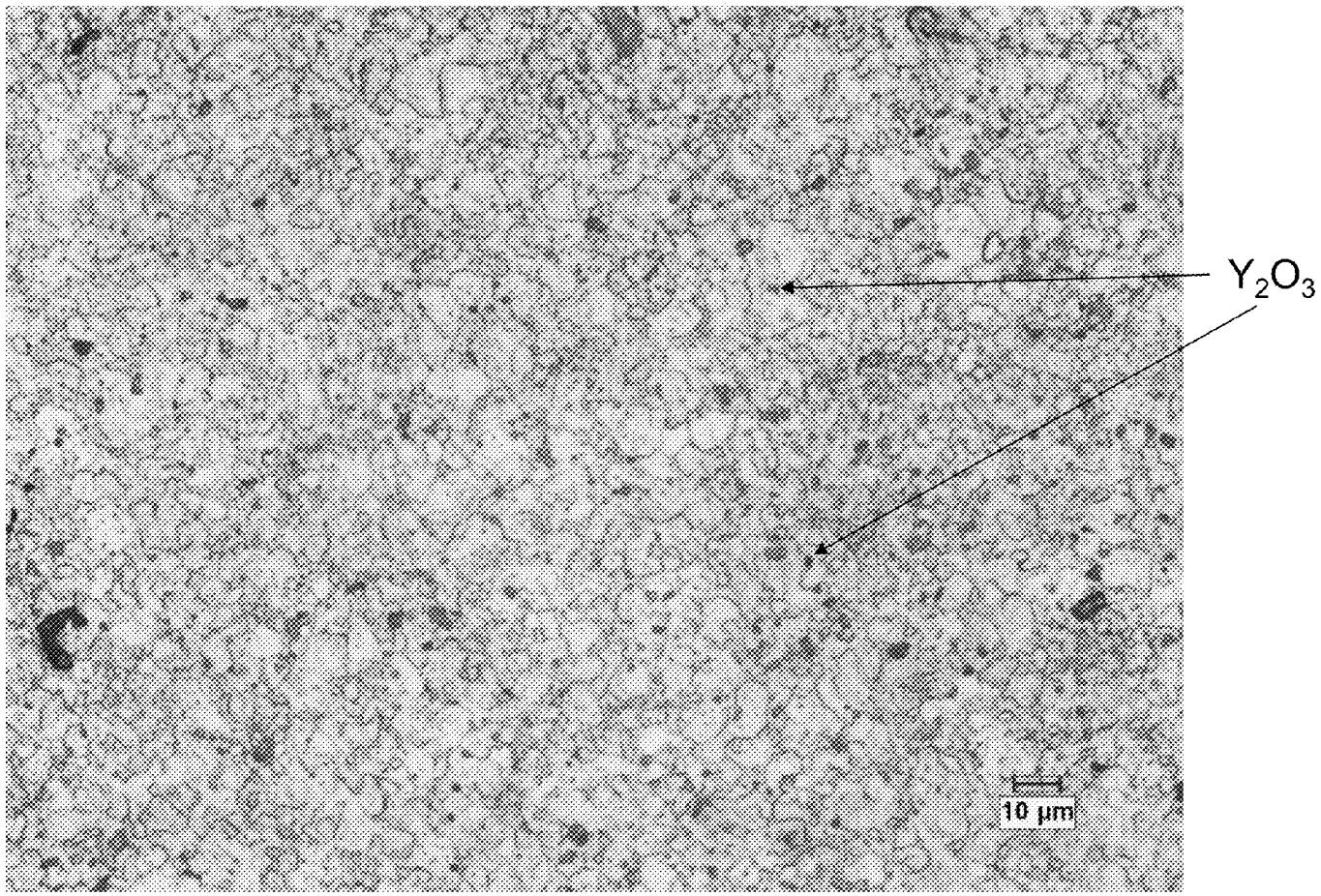
FIG. 9 is an image of a microstructure of an exemplary electrode material composition of Ru-5Rh-1Re-1$Y_2O_3$ (wt %), taken after sintering but before extrusion.

Turning to FIG. 9, a microstructure of an exemplary electrode material composition of Ru-5Rh-1Re-1$Y_2O_3$—taken after sintering but before extrusion—is shown. In this example, the electrode material has a microstructure with a solid solution ruthenium phase and substantially homogeneously dispersed metal oxide particles. The electrode material has an average density of about 12.17 g/cm$^3$ and has a hardness of about 489 HK. The electrode material in this example has a grain size that is less than about 10 μm. The grain sizes referenced in this description can be determined by using a suitable measurement method, such as the Planimetric method outlined in ASTM E112.

It is to be understood that the foregoing is a description of one or more preferred exemplary embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

As used in this specification and claims, the terms "for example," "e.g.," "for instance," "such as," and "like," and the verbs "comprising," "having," "including," and their other verb forms, when used in conjunction with a listing of one or more components or other items, are each to be construed as open-ended, meaning that that the listing is not to be considered as excluding other, additional components or items. Other terms are to be construed using their broadest reasonable meaning unless they are used in a context that requires a different interpretation.

The invention claimed is:

1. A spark plug, comprising:

a metallic shell having an axial bore;

an insulator having an axial bore and being at least partially disposed within the axial bore of the metallic shell;

a center electrode being at least partially disposed within the axial bore of the insulator; and a ground electrode being attached to a free end of the metallic shell;

wherein the center electrode, the ground electrode, or both has an electrode material that includes ruthenium (Ru) as the single largest constituent on a wt % basis, at least one precious metal other than ruthenium (Ru), and at least one metal oxide selected from the group consisting of: $Al_2O_3$, $ZrO_2$, MgO, $SnO_2$, CaO, $Cr_2O_3$, $CeO_2$, HfO, $Y_2O_3$, SiC, or $La_2O_3$.

2. The spark plug of claim 1, wherein the electrode material includes the metal oxide $Al_2O_3$ or $Y_2O_3$.

3. The spark plug of claim 1, wherein the electrode material includes the metal oxide from about 0.1 wt % to 5.0 wt %, inclusive.

4. A spark plug, comprising:

a metallic shell having an axial bore;

an insulator having an axial bore and being at least partially disposed within the axial bore of the metallic shell;

a center electrode being at least partially disposed within the axial bore of the insulator; and a ground electrode being attached to a free end of the metallic shell;

wherein the center electrode, the ground electrode, or both has an electrode material that includes ruthenium (Ru) as the single largest constituent on a wt % basis, at least one precious metal other than ruthenium (Ru), and a thin, outer, protective oxide layer that is formed from the precious metal and improves the corrosion and/or erosion resistance of the electrode material.

5. A spark plug, comprising:

a metallic shell having an axial bore;

an insulator having an axial bore and being at least partially disposed within the axial bore of the metallic shell;

a center electrode being at least partially disposed within the axial bore of the insulator; and a ground electrode being attached to a free end of the metallic shell;

wherein the center electrode, the ground electrode, or both has an electrode material that includes ruthenium (Ru) as the single largest constituent on a wt % basis, at least one precious metal other than ruthenium (Ru), and at least one refractory metal selected from the group consisting of: tungsten (W), rhenium (Re), tantalum (Ta), molybdenum (Mo), or niobium (Nb).

6. The spark plug of claim 5, wherein the electrode material includes the refractory metal rhenium (Re).

7. The spark plug of claim 5, wherein the electrode material includes the refractory metal from about 0.1 wt % to 5.0 wt %, inclusive.

8. A spark plug, comprising:

a metallic shell having an axial bore;

an insulator having an axial bore and being at least partially disposed within the axial bore of the metallic shell;

a center electrode being at least partially disposed within the axial bore of the insulator; and a ground electrode being attached to a free end of the metallic shell;

wherein the center electrode, the ground electrode, or both has an electrode material that includes ruthenium (Ru) as the single largest constituent on a wt % basis, at least one precious metal other than ruthenium (Ru), and at least one active element selected from the group consisting of: aluminum (Al), titanium (Ti), zirconium (Zr), scandium (Sc), yttrium (Y), halfnium (Hf), lanthanum (La), or actinium (Ac).

9. The spark plug of claim 8, wherein the electrode material includes the active element from about 10 ppm to 0.5 wt %, inclusive.

10. A spark plug, comprising:

a metallic shell having an axial bore;

an insulator having an axial bore and being at least partially disposed within the axial bore of the metallic shell;

a center electrode being at least partially disposed within the axial bore of the insulator; and a ground electrode being attached to a free end of the metallic shell;

wherein the center electrode, the ground electrode, or both has an electrode material that is a multi-phase material that includes a matrix phase and a dispersed phase, the matrix phase includes ruthenium (Ru) and the at least one precious metal and the dispersed phase includes the at least one metal oxide, and ruthenium (Ru) is the single largest constituent on a wt % basis.

11. The spark plug of claim 10, wherein the dispersed phase includes metal oxide particles that are dispersed within the matrix phase and have a mean particle size from about 1 nm to 20 μm.

12. The spark plug of claim 10, wherein the dispersed phase includes metal oxide fibers that are dispersed within the matrix phase and have a mean length from about 50 μm to 500 μm and a mean diameter that is less than about 10 μm.

13. A spark plug electrode, comprising:

an electrode material that includes a matrix phase having ruthenium (Ru) and a dispersed phase having at least one metal oxide, wherein the ruthenium (Ru) is the single largest constituent of the electrode material on a wt % basis.

* * * * *